US008752597B2

(12) United States Patent
Tumarkin

(10) Patent No.: US 8,752,597 B2
(45) Date of Patent: Jun. 17, 2014

(54) FUEL DISPENSING NOZZLE

(75) Inventor: Vadim Tumarkin, Madison, WI (US)

(73) Assignee: Franklin Fueling Systems, Inc., Madison, WI (US)

( * ) Notice: Subject to any disclaimer, the term of this patent is extended or adjusted under 35 U.S.C. 154(b) by 657 days.

(21) Appl. No.: 13/119,376

(22) PCT Filed: Sep. 16, 2009

(86) PCT No.: PCT/US2009/057118

§ 371 (c)(1),
(2), (4) Date: Jun. 6, 2011

(87) PCT Pub. No.: WO2010/033566

PCT Pub. Date: Mar. 25, 2010

(65) Prior Publication Data

US 2011/0272063 A1 Nov. 10, 2011

(30) Foreign Application Priority Data

Sep. 17, 2008 (WO) ..... PCT/US2008/076668

(51) Int. Cl.
*B67D 7/42* (2010.01)
*B67D 7/54* (2010.01)

(52) U.S. Cl.
CPC ... *B67D 7/42* (2013.01); *B67D 7/54* (2013.01)
USPC ..... 141/206; 141/302; 141/392; 29/469

(58) Field of Classification Search
USPC ..... 141/206, 392.387, 302, 1, 8; 29/428, 29/469; 222/566
See application file for complete search history.

(56) References Cited

U.S. PATENT DOCUMENTS

| | | | |
|---|---|---|---|
| 4,155,573 | A | 5/1979 | Ehlers |
| 4,331,187 | A | 5/1982 | Trygg |
| 4,450,879 | A | 5/1984 | Wood |
| 4,735,243 | A | 4/1988 | Ehlers |
| 5,178,197 | A | 1/1993 | Healy |

(Continued)

FOREIGN PATENT DOCUMENTS

| | | |
|---|---|---|
| AU | 2009213108 | 4/2010 |
| BE | 1010348 | 6/1998 |

(Continued)

OTHER PUBLICATIONS

Russian Office Action dated Aug. 22, 2012 in corresponding Russian Application No. 2011114997/12 together with English language translation of such Office Action.

(Continued)

*Primary Examiner* — Timothy L Maust
*Assistant Examiner* — Timothy P Kelly
(74) *Attorney, Agent, or Firm* — Faegre Baker Daniels LLP

(57) ABSTRACT

A fluid dispensing nozzle includes a removable valve subassembly that controls the flow of fluid and the recovery of fluid vapor through the body of the nozzle. The subassembly may be pre-assembled and installed within a nozzle body as a single unit. The nozzle may include a vacuum-driven automatic shut-off system which prevents fluid from flowing through the nozzle when the downstream end of the nozzle spout is submerged. The shutoff system may also be magnetically actuated to allow for dry testing in which the automatic shut-off functionality is testing without dispensation of fluid.

16 Claims, 11 Drawing Sheets

(56) References Cited

U.S. PATENT DOCUMENTS

| | | | | |
|---|---|---|---|---|
| 5,316,057 | A | 5/1994 | Hasselmann | |
| 5,346,260 | A | 9/1994 | Meyer-Berg et al. | |
| 5,363,889 | A * | 11/1994 | Simpson et al. | 141/208 |
| 5,386,859 | A * | 2/1995 | Healy | 141/59 |
| 5,435,356 | A | 7/1995 | Rabinovich | |
| 5,645,115 | A * | 7/1997 | Kesterman et al. | 141/206 |
| 5,715,875 | A | 2/1998 | Clary et al. | |
| 6,095,204 | A | 8/2000 | Healy | |
| 6,151,955 | A | 11/2000 | Ostrowski et al. | |
| 6,192,609 | B1 | 2/2001 | Alvern | |
| 6,532,999 | B2 | 3/2003 | Pope et al. | |
| 7,174,926 | B1 | 2/2007 | Grantham | |
| 7,509,982 | B2 | 3/2009 | Grantham | |
| 7,543,611 | B2 | 6/2009 | Kaelberg | |
| 7,987,878 | B1 | 8/2011 | Imler | |
| 2010/0126626 | A1 | 5/2010 | Falckenberg et al. | |
| 2011/0186176 | A1 | 8/2011 | Aehle et al. | |
| 2011/0219860 | A1 | 9/2011 | Tumarkin | |
| 2011/0277880 | A1 | 11/2011 | Meyer | |

FOREIGN PATENT DOCUMENTS

| | | |
|---|---|---|
| CN | 1628072 | 6/2005 |
| DE | 1 894 230 | 4/1964 |
| DE | 2 063 723 | 7/1972 |
| DE | 24 20 753 | 11/1975 |
| DE | 26 29 348 | 1/1978 |
| DE | 29 44 858 | 5/1981 |
| DE | 29 47 170 | 6/1981 |
| DE | 33 20 156 | 12/1984 |
| DE | 35 28 612 | 12/1986 |
| DE | 36 37 901 | 5/1987 |
| DE | 37 10 952 | 7/1988 |
| DE | 40 28 571 | 2/1991 |
| DE | 41 14 813 | 4/1992 |
| DE | 42 02 956 | 3/1993 |
| DE | 42 32 742 | 3/1994 |
| DE | 42 39 837 | 6/1994 |
| DE | 44 16 953 | 6/1995 |
| DE | 44 31 547 | 10/1995 |
| DE | 195 20 284 | 12/1995 |
| DE | 44 47 187 | 2/1996 |
| DE | 196 38 845 | 9/1998 |
| DE | 10 2006 022 662 | 2/2007 |
| EP | 0 222 323 | 5/1987 |
| EP | 0 460 296 | 12/1991 |
| EP | 0 512 412 | 11/1992 |
| EP | 0 555 558 | 8/1993 |
| EP | 0 682 201 | 11/1995 |
| EP | 0 687 647 | 12/1995 |
| EP | 0 703 186 | 3/1996 |
| EP | 0 813 016 | 12/1997 |
| EP | 0 734 413 | 3/1999 |
| EP | 1 275 613 | 1/2003 |
| EP | 1 327 604 | 7/2003 |
| EP | 1 398 295 | 3/2004 |
| EP | 2 096 080 | 9/2009 |
| ES | 2 079 778 | 1/1996 |
| ES | 2 232 685 | 6/2005 |
| FR | 2 269 018 | 11/1975 |
| FR | 2 586 014 | 2/1987 |
| GB | 1 505 888 | 3/1978 |
| GB | 2 091 610 | 8/1982 |
| GB | 2 134 883 | 8/1984 |
| GB | 2 144 665 | 3/1985 |
| RU | 42077 | 11/2004 |
| WO | 93/15493 | 8/1993 |
| WO | 95/16737 | 6/1995 |

OTHER PUBLICATIONS

Chinese Office Action dated Oct. 26, 2012 in corresponding Chinese Application No. 200980136100.4 together with English language translation of same.

Chinese Office Action dated Nov. 2, 2012 in corresponding Chinese Patent Application No. 200880131141.X.

International Search Report dated Oct. 4, 2010 in International Application No. PCT/US2009/057118.

International Search Report dated Jul. 22, 2009 in International Application No. PCT/US2008/076668.

International Preliminary Report on Patentability dated Dec. 15, 2010 in corresponding PCT Application No. PCT/US2008/076668.

International Preliminary Report on Patentability dated Mar. 22, 2011 in PCT Application No. PCT/US2009/057118.

* cited by examiner

FUEL DISPENSING NOZZLE

CROSS-REFERENCE TO RELATED APPLICATION

This application is a U.S. National Phase Patent Application under 35 U.S.C. §371 of International Application Serial No. PCT/US2009/057118, filed Sep. 16, 2009 and claims the benefit under 35 U.S.C. §119 and 35 U.S.C. § 365 of International Application No. PCT/US2008/076668, filed Sep. 17, 2008, the entire disclosures of which are hereby expressly incorporated herein by reference.

TECHNICAL FIELD

The present invention relates to a fluid dispensing nozzle, and more particularly, to a fluid dispensing nozzle having a vapor recovery system.

SUMMARY

A fluid dispensing nozzle includes a removable valve subassembly that controls the flow of fluid and the recovery of fluid vapor through the body of the nozzle. The subassembly may be pre-assembled and installed within a nozzle body as a single unit. The nozzle may include a vacuum-driven automatic shut-off system which prevents fluid from flowing through the nozzle when the downstream end of the nozzle spout is submerged in fluid. The shutoff system may also be magnetically actuated to allow for dry testing in which the automatic shut-off and vapor recovery functionalities are tested without dispensation of fluid.

In one embodiment a fuel dispensing nozzle includes a nozzle body having a fluid inlet end and a fluid outlet end, a vapor control valve, and a fluid control valve. An actuator is moveable between an inactive position and an active position. A fluid control component is disposed within the nozzle body and has a first end adjacent to the fluid control valve, the fluid control component moveable between a closed position in which the fluid control component maintains the fluid control valve in a closed position, and an open position in which the fluid control component permits the fluid control valve to move to an open position in response to a flow of fuel. A vapor control component is coupled to the actuator and the vapor control valve, the vapor control component moveable between a closed position and an open position in response to movement of the actuator from the inactive to the active position. The vapor control valve is opened in response to movement of the vapor control component from the closed position to the open position. One or more coupling members are disposed in the nozzle body, the coupling members moveable between an engaged position engaging the fluid and vapor control components and a disengaged position disengaging at least the fluid vapor control component. Both the fluid and vapor control components are moveable in response to movement of the actuator when the coupling members are in the engaged position, and the vapor control component is independently moveable in response to movement of the actuator when the coupling members are in the disengaged position.

In one aspect, the vapor control component may be coupled to the vapor control valve with a rod. The vapor control component may be a cylinder.

In another aspect, the actuator may include a projection extending into the nozzle body, and the projection pivots in response to movement of the actuator.

In another aspect, the vapor control component may include an aperture sized to receive the projection, and the vapor control component is moveable to the open position in response to pivoting of the projection.

In yet another aspect, the vapor control component may be disposed within the fluid control component and freely moveable therein, and the fluid control component comprises a pair of elongate slots sized to receive the projection such that the projection is freely moveable therein.

In another aspect, the fluid control component may be a cylinder.

In yet another aspect, the fluid control component may be seated against the fluid control valve when in the closed position, to maintain the fluid control valve in the closed position, and the fluid control component is disposed away from the fluid control valve when in the open position.

In still another aspect, a shutoff spring may be included. The shutoff spring maintains the fluid control component in the closed position when the actuator is in the inactive position.

In another aspect the coupling members may be cylindrical rollers. There may be two coupling members.

In yet another aspect, a diaphragm may be disposed in a chamber of the nozzle body and coupled to the coupling members, the diaphragm moveable from an inner position to an outer position. The coupling members are moved to the disengaged position in response to movement of the diaphragm to the outer position. A magnetic collar may be coupled to the diaphragm. A bracket may couple the diaphragm and the coupling members, the bracket including a top surface coupled to the diaphragm, and two arms inwardly projecting from the top surface, each arm having a slot for receiving the coupling members. The coupling members are moveable along the slots.

In still another aspect, a pressure sensing spring may be coupled to the diaphragm, the pressure sensing spring moveable from a compressed position to an extended position in response to a loss of fuel pressure within the nozzle body. The diaphragm may be moveable in response to movement of the pressure sensing spring, and movement of the pressure sensing spring to the extended position forces the diaphragm and the coupling members to the disengaged positions, preventing opening of the fluid control valve.

In another aspect, a product badge may include one or more pins downwardly projecting from the product badge. The one or more pins cooperate with one or more pin receiving grooves disposed on a top exterior surface of the nozzle body to retain the product badge on the nozzle body. The product badge may include a first portion and a second portion. A boot may be disposed over the nozzle body and the second portion of the product badge to retain the product badge on the nozzle body.

In yet another aspect, a spout may be coupled to the fluid outlet end of the nozzle body. An attitude sensing mechanism may be included, with the attitude sensing mechanism preventing dispensing of fuel if at least a portion of the spout is disposed above the horizontal.

In another embodiment, a method of dry testing a vapor recovery ability of a fuel dispensing nozzle is provided. The fuel dispensing nozzle includes a nozzle body comprising a fluid inlet end and a fluid outlet end, a vapor control valve, and a fluid control valve, an actuator moveable between an inactive position and an active position, a fluid control component disposed within the nozzle body and moveable between a closed position in which the fluid control component maintains the fluid control valve in a closed position, and an open position in which the fluid control component permits the fluid control valve to move to an open position in response to a flow of fuel. The nozzle also includes a vapor control component coupled to the actuator and the vapor control valve, the vapor control component moveable between a closed position and an open position in response to movement of the actuator from the inactive to the active position, wherein the vapor control valve is opened in response to movement of the vapor control component from the closed position to the open position. At least one coupling member is disposed in the nozzle body, the coupling members moveable between an engaged position engaging the fluid and vapor control components and a disengaged position disengaging at least the vapor control component, wherein both the fluid and vapor control components are moveable in response to movement of the actuator when the coupling members are in the engaged position, and the vapor control component is independently moveable in response to movement of the actuator when the coupling members are in the disengaged position. The method includes placing a magnet over the magnetic collar at an exterior portion of the nozzle body, with a magnetic force of the magnet causing the magnetic collar coupled to the at least one coupling member to move toward the magnet, forcing the at least one coupling member to the disengaged position, and moving the actuator to the active position, so that the vapor control component is moved to the open position in response to the movement of the actuator and the vapor control component forces the vapor control valve to the open position. Vapor is then drawn through the vapor control valve with the fluid control valve maintained in the closed position.

In a third embodiment, a nozzle for dispensing fluid includes a nozzle body having an inlet end and an outlet end and a self-contained valve subassembly receivable within and separable from the nozzle body. The valve subassembly includes a fluid control component moveable between an open position and a closed position, a carriage sized to receive the fluid control component, an intermediate component secured to the carriage, the intermediate component having a valve seat, and a valve having a valve body, the valve moveable from a closed position in which the valve body is seated in the valve seat to an open position in which the valve body is spaced away from the valve seat. The valve is moveable to its open position when the fluid control component is in its open position. The securement of the carriage to the intermediate component captures the fluid control component and the valve between the carriage and the intermediate component to form the self-contained valve subassembly.

In one aspect, the self-contained valve subassembly includes a biasing means for closing the valve, the biasing means biasing the fluid control component toward the valve body. The securement of the carriage to the intermediate component further captures the biasing means between the carriage and the intermediate component.

In another aspect, the nozzle includes a vapor recovery system including the self-contained valve subassembly with a vapor control component moveable between an open position and a closed position, the carriage sized to receive the vapor control component, the securement of the carriage to the intermediate component further capturing the vapor control component between the carriage and the intermediate component, and a vapor control valve coupled with the vapor control component. The vapor recovery system also includes at least one coupling member disposed in the nozzle body, the coupling member moveable between an engaged position in which the fluid control component the said vapor control component are coupled, and a disengaged position in which the fluid control component and the vapor control component are decoupled. The vapor control component is moveable with respect to the fluid control component when the at least one coupling member is in the disengaged position.

In yet another aspect, the self-contained valve subassembly includes a rolling diaphragm having a first end and a second end, the rolling diaphragm sealingly coupled to the vapor control valve at the first end and sealingly coupled to the intermediate member at the second end. The securement of the carriage to the intermediate component further captures the rolling diaphragm between the carriage and the intermediate component. The vapor control valve may be positioned to interrupt a vapor flow path and the fluid control valve may be positioned to interrupt a fluid flow path, with the rolling diaphragm disposed between the vapor flow path and the fluid flow path.

In still another aspect, the nozzle includes a coupler having a valve seat shaped to cooperate with the vapor control valve, the coupler threadably engaging the nozzle body at the inlet portion, and the valve subassembly being urged toward the outlet portion by the coupler when the coupler is threadably engaged with the nozzle body. A biasing means for closing the vapor control valve may be provided. The biasing means biases the vapor control component toward the vapor control valve, the vapor control component urging the vapor control valve toward the valve seat. The securement of the carriage to the intermediate component further captures the biasing means for closing the vapor control valve between the carriage and the intermediate component.

In a fourth embodiment, a method of assembling a nozzle includes the steps of pre-assembling a self-contained valve subassembly, inserting the self-contained valve subassembly into a nozzle body of the nozzle, and attaching a coupler to the nozzle body, the coupler urging the valve assembly in the direction of insertion to couple the valve subassembly with the nozzle body. The step of pre-assembling includes installing at least one biasing element in to a carriage, installing a fluid control component in to the carriage so that the fluid control component is operatively coupled with the biasing element within the carriage, coupling a control valve to the fluid control component, and at least partially compressing the spring by engaging an intermediate component with the carriage. The intermediate component captures the biasing element and the control valve when the intermediate component engages with the carriage.

In a fifth embodiment, a fuel dispensing nozzle includes a nozzle body with a fluid inlet end and a fluid outlet end, a fluid control valve disposed within the nozzle body and moveable between a closed position in which the fluid control valve prevents fluid from flowing through the nozzle body, and an open position in which the fluid control valve permits fluid to flow through the nozzle body. The nozzle also includes a vapor control valve disposed within the nozzle body and moveable between a closed position in which the vapor control valve prevents vapor from passing through the nozzle body, and an open position in which the vapor control valve permits vapor to flow through the nozzle body. At least one coupling member is disposed in the nozzle body, and is moveable between an engaged position in which the fluid control component and the vapor control component are coupled, and a disengaged position in which the fluid control component and the vapor control component are decoupled. A magnetic collar is coupled to the at least one coupling member, the magnetic collar moveable between a magnetized position in which the at least one coupling member is in the disengaged position and a non-magnetized position in which the coupling member is moveable to the engaged position.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION

Figure 1A:
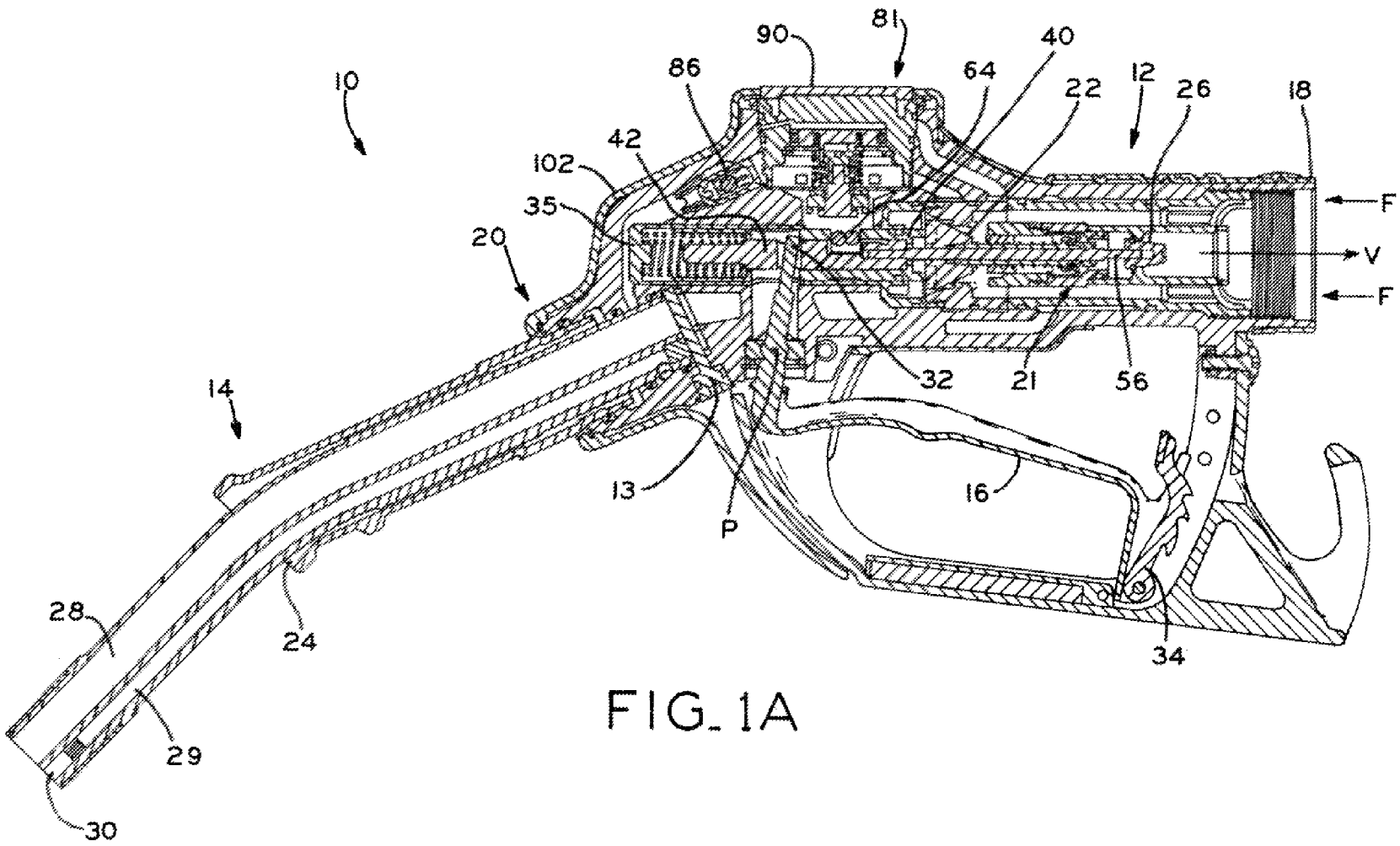
FIG. 1A is a sectional view of a nozzle in accordance with an embodiment of the invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Figure 1B:
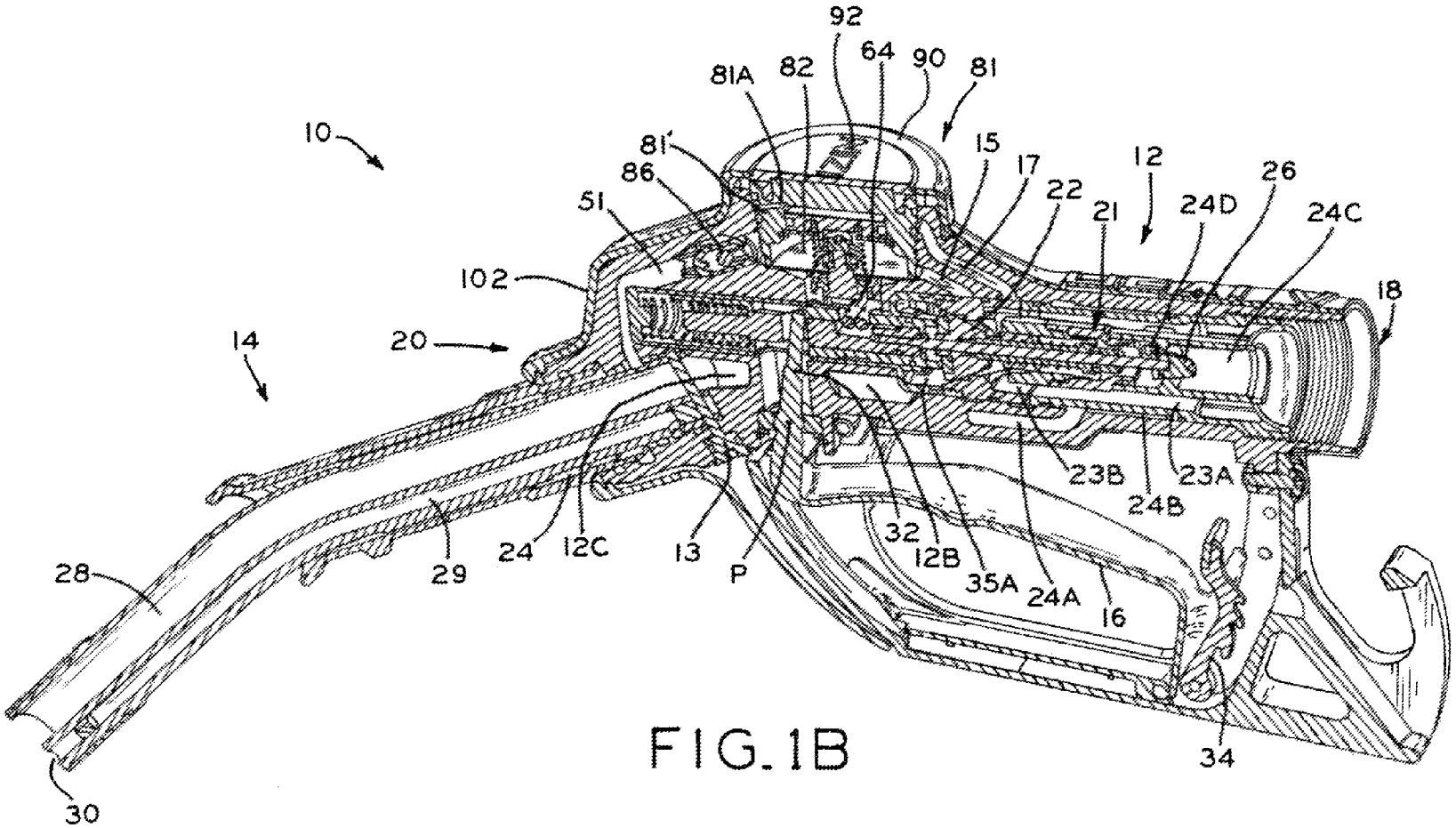
FIG. 1B is a perspective, sectional view of the nozzle shown in FIG. 1A.
Figure 2:
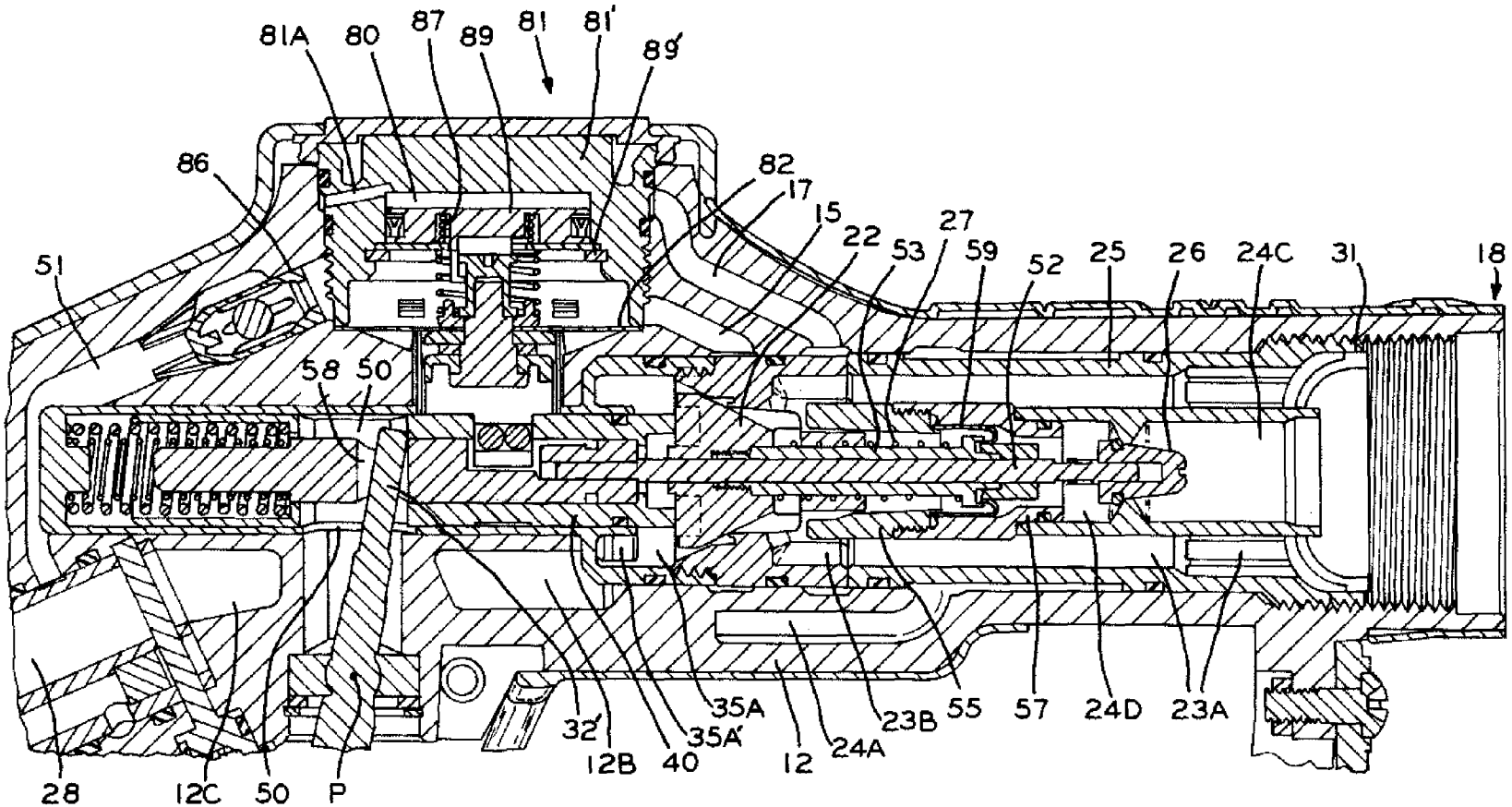
FIG. 2 is a partial sectional view of the nozzle shown in FIG. 1A, illustrating a valve subassembly and an automatic shutoff system.

Referring to FIGS. 1 and 2, fluid dispensing nozzle 10, such as for dispensing fuel from a conventional fuel storage tank at a retail gasoline station, is disclosed. Nozzle 10 includes nozzle body 12, spout 14, and actuator 16. Nozzle body 12 has fluid inlet end 18 and fluid outlet end 20. For convenience, inlet end 18 will be generally referred to herein as the "upstream" portion of nozzle 10 and fluid outlet end 20 will be generally referred to herein as the "downstream" portion of nozzle 10. Spout 14 is coupled to the fluid outlet end 20 of the nozzle body 12 by retention pin 13. Nozzle body 12 includes a valve subassembly 21 received therein for controlling the flow of fluid and vapor through the nozzle 10, as described in detail below.

Spout 14 is sized to fit within a fill tank, such as a fuel tank of a vehicle, and includes fluid passage 28 for fluid flow. Typically, nozzle 10 is connected to a conventional fuel dispenser (not shown) via a conventional hose (not shown) operatively coupled to nozzle body 12 at fluid inlet end 18. The dispenser dispenses fuel from a conventional fuel storage tank (not shown) through the hose to the fluid inlet. Upon activation of actuator 16, fuel flows from fluid inlet end 18 through nozzle body 12 via control valve body 22 and out through fluid passage 28 of spout 14. Control valve body 22 selectively interrupts the flow of fluid through nozzle body 12, as discussed in detail below.

Nozzle 10 includes a vapor recovery system to recover fluid vapors emitted during dispensation of fluid. As described in detail below, the vapor recovery system is controlled by vapor control valve 26. Vapor control valve 26 controls the flow of recovered vapors from the spout 14 through the nozzle body 12 to the dispenser by selectively interrupting a flow path of the vapors withing nozzle body 12, as discussed in detail below. Vapor control valve 26 is biased in a closed or interrupting position when the nozzle 10 is off. This prevents the return of air to the storage tank when nozzle 10 is not in use. When nozzle 10 is on, vapor control valve 26 is opened to allow for recovery of vapors from the tank being filled. Vapor control valve 26 may be disposed closer to the fluid inlet end 18 of the nozzle body 12 than the fluid control valve body 22. Vapor control valve 26 may have a parabolic cross section so that vapor flow past vapor control valve 26 is generally proportional to the position of vapor control valve 26. Alternatively, vapor control valve 26 may be shaped to have an on/off functionality, so that even a small movement of vapor control valve from the closed to the open position will result in maximal vapor flow past vapor control valve 26.

Figure 5:
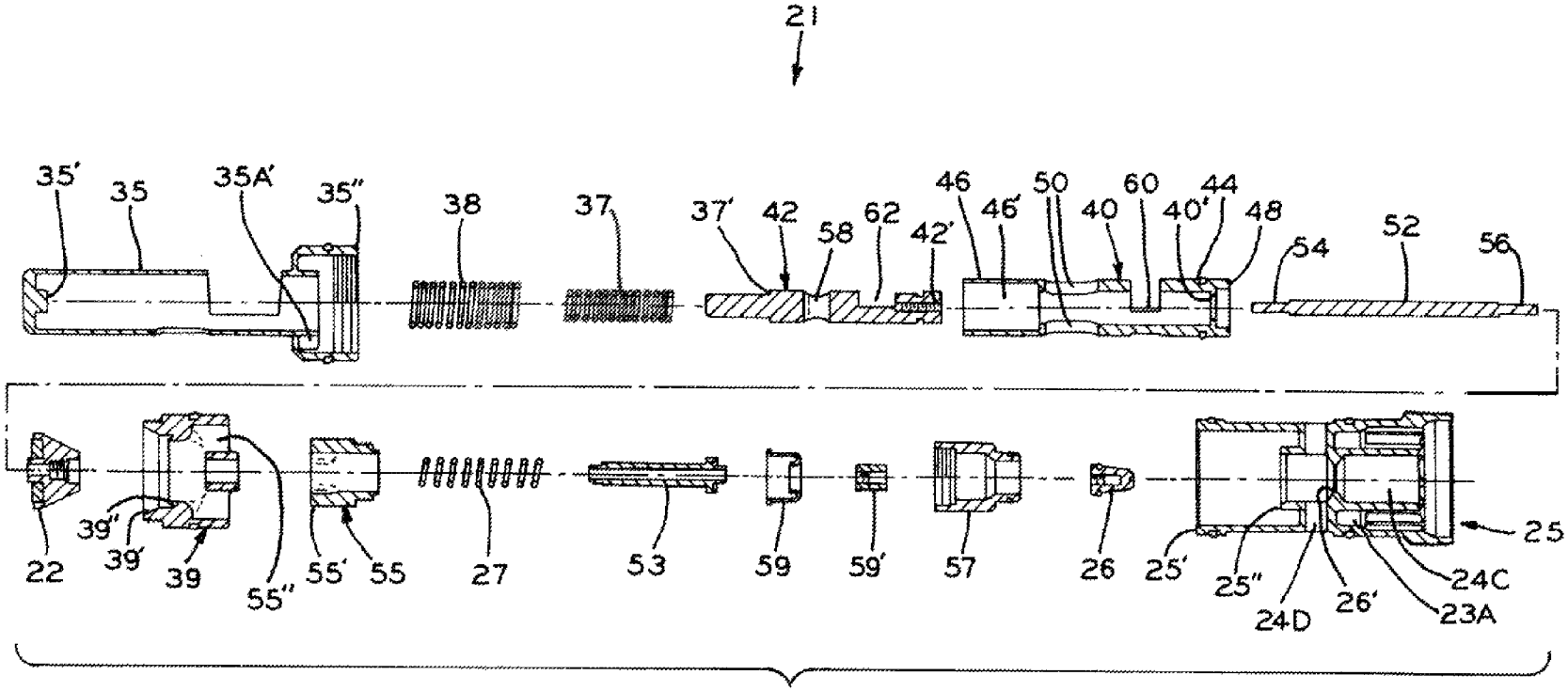
FIG. 5 is an exploded, sectional view of the valve subassembly and coupler shown in FIG. 4.

As best shown in FIG. 1B, the vapor recovery system includes vapor return channel 24 extending along at least a portion of the exterior surface of spout 14. Channel 24 is in fluid communication with a channel portion 24A via a passageway through nozzle body 12 (not shown in the section view plane of FIGS. 1A and 2). Moving further toward input end 18 of nozzle body 12, channel portion 24A connects with an outer channel portion 24B. Channel 24B is in fluid communication with an inner channel portion 24C via a laterally extending passageway 24D (FIGS. 1B and 5). Thus, vapors flow from the fill tank into the spout 14 through the vapor return channels 24-24D and out of nozzle body 12 via path V (FIG. 1A). As discussed in detail below, the flow of vapor from channel 24 to channel portion 24D is controlled by vapor control valve 26 disposed at fluid inlet end 18 of nozzle body 12 between channel portions 24C and 24D.

Advantageously, the vapor recovery system recovers vapors from within a fill tank, such as from a vehicle's fuel tank, which might otherwise escape to the atmosphere during filling. Recovered vapor can then be returned to the fluid storage tank, for example.

Referring to FIGS. 1A and 2, actuator 16 is disposed generally along the exterior of nozzle body 12. When actuator 16 is in an inactive or lowered position, nozzle 10 is off and fluid no fluid is dispensed. Actuator 16 is moveable from the inactive position to an active or raised position, such as by moving it toward nozzle body 12 from the inactive to the active position. When actuator 16 is actuated to the active position, nozzle 10 is on and will permit dispensing fluid therethrough subject to certain overriding shut-off conditions as described below.

Actuation of actuator 16 to the active position can open both fluid control valve body 22 and vapor control valve 26. Referring now to FIG. 2, actuator 16 includes projection 32 that extends through the outer surface of nozzle body 12 and slot 50 of fluid control component 40 to engage vapor control component 42, as discussed below. Actuation of the actuator 16 to the open position forces projection 32 to pivot about pivot point P, moving end 32' of projection 32 toward the fluid outlet end 20 of the nozzle body 12. The actuator 16 may include a conventional latch 34 (FIG. 1B) that retains the actuator 16 in the open position during filling of the fill tank.

Figure 3:
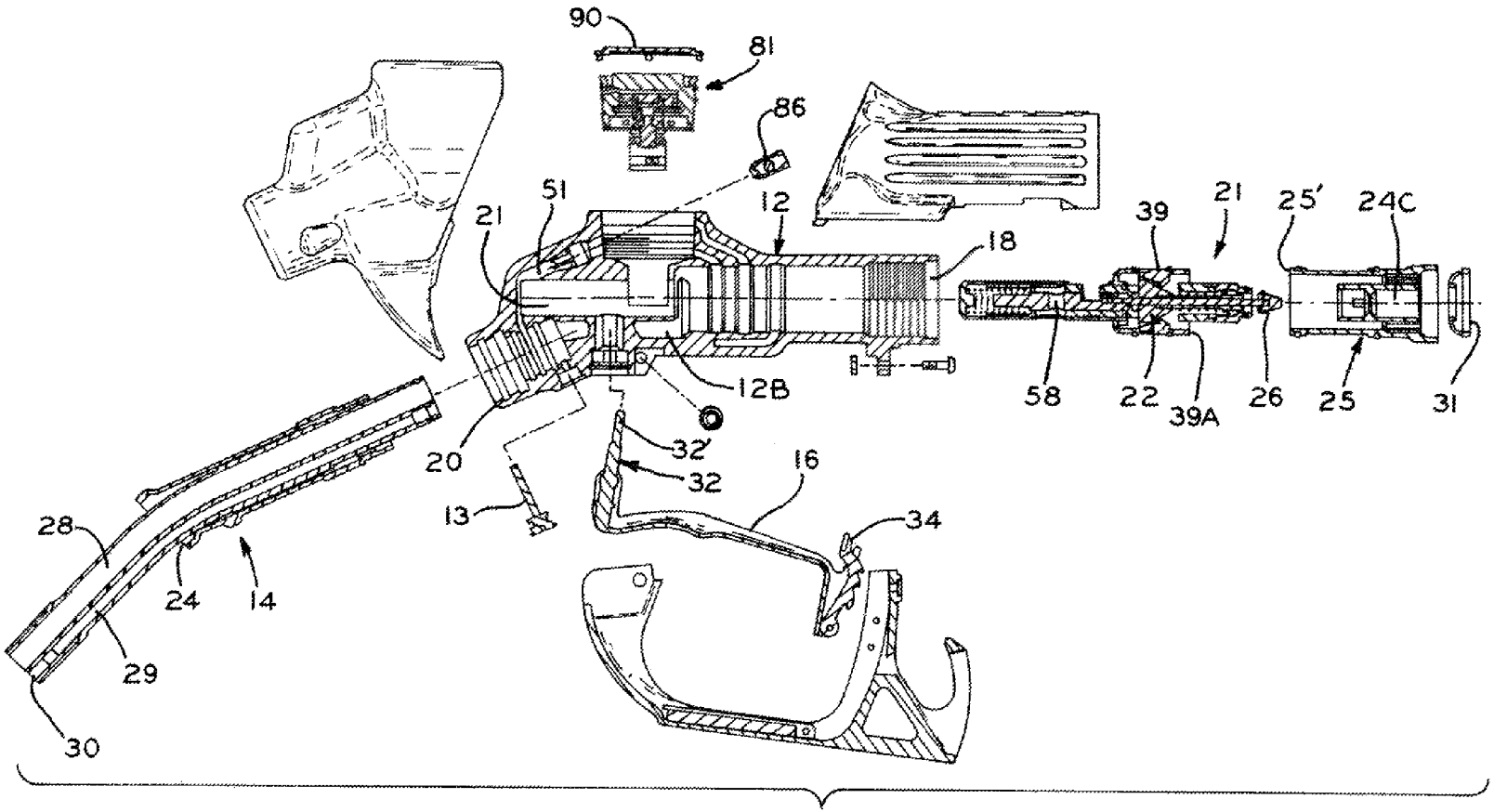
FIG. 3 is an exploded, sectional view of the nozzle shown in FIG. 1A.
Figure 4:
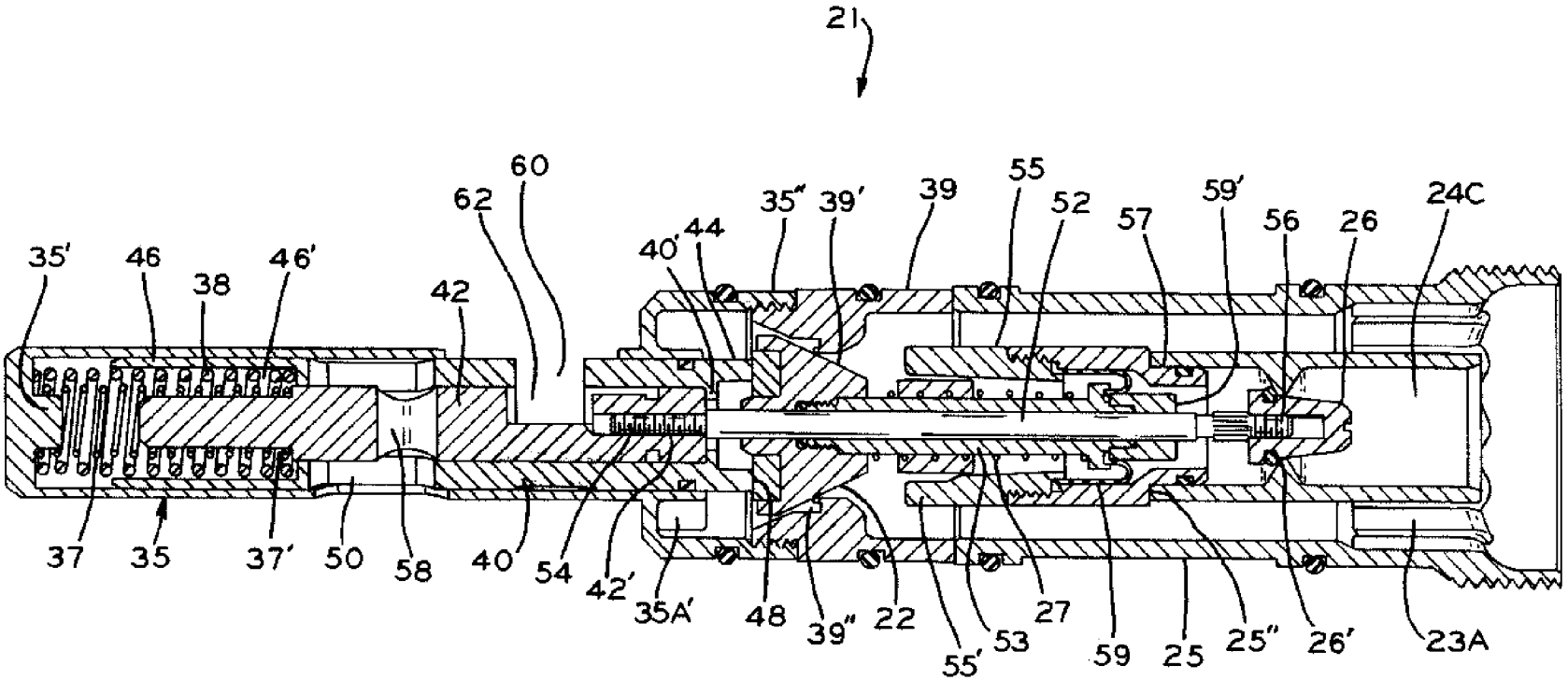
FIG. 4 is a sectional view of a valve subassembly in accordance with the present invention and a coupler abutted to the valve subassembly.
Figure 6:
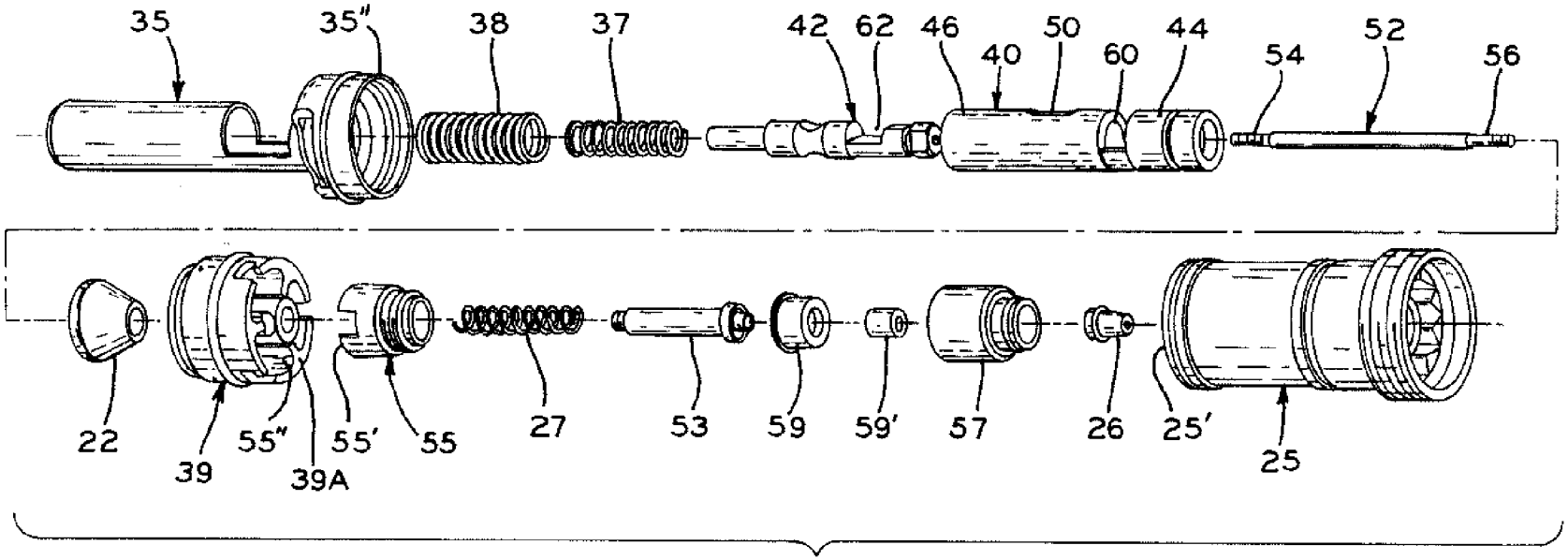
FIG. 6 is an exploded, perspective view of the valve subassembly and coupler shown in FIG. 4.

Referring to FIGS. 4-6, fluid control component 40 includes first end 44 and second end 46 (FIGS. 5 and 6). First end 44 of fluid control component 40 is disposed adjacent the fluid control valve body 22 (FIG. 4). Fluid control component 40 is moveable between a closed and an open position. Fluid control valve body 22, which may be a check valve, for example, controls fluid flow through nozzle body 12 and out through spout 14. Fluid control valve body 22 is disposed within nozzle body 12 as part of subassembly 21 (FIGS. 3 and 4).

Fluid control valve body 22 and valve seat 39' form a fluid control valve. When in the closed or shut-off position, fluid control valve body 22 seats against a valve seat 39' formed on intermediate fluid conducting component 39 to prevent fluid flow through nozzle 10. More particularly, fluid control component 40 urges fluid control valve body 22 toward valve seat 39' by a force exerted by shutoff spring 38, which is a compression spring. The fluid control valve body 22 is also biased to a closed position by valve spring 27, which is a tension spring that is weaker than shutoff spring 38. Valve spring 27 may, for example, be just strong enough to prevent leakage through valve body 22 under light fluid pressure, such as to pass leakage inspections. In one exemplary embodiment, spring 27 may provide enough biasing force to prevent valve body 22 from opening under the pressure exerted by the gravitational weight of a 2-meter column of water in a standard hose coupled to inlet 18. It is within the scope of the invention that any other known biasing element may be used in place of springs as used herein. It is also within the scope of the present invention that valve seat 39' may be formed as a separate part or component from intermediate component 39, or is formed within one of the other components within valve subassembly 21.

Intermediate component 39 includes a plurality of venturi holes 39" disposed at valve seat 39'. When the fluid control valve body 22 is in the open position, fluid passing through fluid control valve body 22 and past the valve seat 39' creates a venturi effect, which produces a vacuum within nozzle body 12 through venturi holes 39". As will be discussed further below, this vacuum provides proper functioning for automatic shut-off system 81.

First end 44 of the fluid control component 40 may include an outwardly projecting ring or shoulder 48 (FIGS. 4 and 5). The ring can be used to more securely seat the fluid control component 40 against the fluid control valve body 22.

Vapor control component 42 is disposed within the fluid control component 40 so that components 40, 42 share a common axis along which each of components 40, 42 are independently moveable. Vapor control component 42 is sized to move freely within the fluid control component 40 along the axis. In an exemplary embodiment, the fluid control component 40 and vapor control component 42 are cylindrical. However, it is within the scope of the invention that the fluid and vapor control components 40, 42 can be disposed adjacent one another, and can take other, non-cylindrical shapes. Fluid and vapor control components 40, 42 are disposed within nozzle body downstream of the fluid and vapor control valves 22, 26, and cooperate with actuator 16 (as discussed above) to open fluid and vapor control valves 22, 26 against biasing forces in response to movement of the actuator 16.

Referring now to FIGS. 4-6, a valve subassembly 21 includes the parts shown in FIG. 4, each of which is replaceable. A carriage 35 receives at its downstream end shutoff spring 38. Vapor spring 37, which is a compression spring in the illustrated embodiment, is in turn received within the inner cavity of shutoff spring 38. Optionally, carriage 35 may include a protrusion 35' at its downstream end, protrusion 35' being receivable within vapor spring 37 to keep springs 37, 38 centered within the inner space of carriage 35.

Fluid control component 40 is also received within carriage 35, with second end 46 of fluid control component 40 having cavity 46' (FIG. 5) sized to receive a portion of shutoff spring 38. Shutoff spring 38 abuts the upstream end of cavity 46'. Vapor control component 42 is received within fluid control component 40, with shoulder 37' of vapor control component 42 abutting the upstream end of vapor spring 37. Inlet portion 35" (FIGS. 5 and 6) of carriage 35 includes threads for threadably engaging intermediate fluid conducting component 39. Upon full threaded engagement of intermediate component 39 with carriage 35, shutoff spring 38 may slightly compress. The biasing force created by this compression urges shoulder 48 of fluid control component 40 in to contact with valve body 22, and the outer frustoconical surface of valve body 22 seats against valve seat 39'.

Next, valve body 22 may be threadably attached to plunger 53 before assembly of carriage 35 to intermediate component 39 to prevent rotation of valve body 22 within seat 39'. Valve spring 27 is placed on plunger 53 prior to threadable engagement with valve body 22, and spring 27 may be slightly biased (i.e., extended) upon full threaded engagement between plunger 53 and valve body 22 similarly to shutoff spring 38.

Additionally, vapor spring 37 may also slightly compress upon assembly of intermediate component 39 to carriage 35. Specifically, fluid control component 40 may include inner shoulder 40' which transmits the downstream motion of vapor control component 42 caused by the threaded engagement between intermediate component 39 and carriage 35.

Rod 52 may then be threadably engaged with vapor control component 42, such as by threading first end 54 of rod 52 into upstream end 42' of vapor control component 42. Rod 52 is received by plunger 53, which threadably engages valve body 22 at its downstream end. Alternatively, rod 52 may be installed before attachment of intermediate component 39 to carriage 35.

Key 55 is then inserted over plunger 53, with tines 55' received by corresponding voids 55" in intermediate component 39 (FIG. 6) to prevent rotation of key 55 with respect to intermediate component 39 (discussed in detail below). A first end of rolling diaphragm 59 is installed at an upstream end of plunger 53, with the first end received between plunger 53 and diaphragm retainer 59' (FIG. 4), thereby operably coupling the first end of rolling diaphragm 59 with valve body 22 via plunger 53. Cap 57 is threadably engaged with key 55 to pinch or encapsulate a downstream or second end of rolling diaphragm 59, thereby operably coupling the second end of rolling diaphragm 59 with intermediate component via key 55 when coupler 25 is installed (as discussed below). An upstream or second end 56 of rod 52 then threadably receives vapor control valve 26 to complete valve subassembly 21. With valve assembly 21 fully assembled, key 55 and cap 57 are axially moveable across a small distance, but are prevented from removal by vapor control valve 26.

Rolling diaphragm 59 has several functions and advantages. It creates a fluid-tight seal between the fluid flow path (which includes the area downstream of rolling diaphragm 59) and the vapor flow path (upstream of rolling diaphragm 59), independent of the relative position of valve body 22. Thus, for example, rolling diaphragm 59 reduces the need for tight dimensional tolerances yielding a high coaxiality between plunger 53 and cap 57, and eliminates the need for a conventional sealing element disposed therebetween. Thus, the resulting large permissible range of part tolerances makes manufacture of these parts and others surrounding them less expensive. Rolling diaphragm is protected from damage during assembly of subassembly 21 by key 55. As coupler 25 is threaded in to nozzle body 12 to capture subassembly 21

(discussed below), rolling diaphragm is prevented from a potentially damaging rotation by the anti-rotation functionality imparted by the interface between tines 55' of key and voids 55".

Thus, valve subassembly 21 is a self-contained unit which may be installed into or removed from valve body 12 as a single or unitary piece. That is to say, when valve subassembly 21 is assembled, an operator picking up one part of valve subassembly 21 will necessarily pick up all other parts of valve subassembly at the same time. Parts between carriage 25 and intermediate 39 are captured or contained or encapsulated when intermediate component 39 is secured to carriage 25, thereby forming self-contained subassembly 21 as one unit.

Advantageously, valve subassembly 21 facilitates easy repair of valve 10 since a malfunctioning valve subassembly 21 can be replaced with a functioning valve subassembly quickly and with minimal effort and time expended in the field. The malfunctioning valve subassembly can be removed or separated from valve body 12, with all the constituent parts of self-contained subassembly 21 being secured to the removed unit. A new or properly functioning self-contained subassembly is then received within nozzle body 12. The malfunctioning valve subassembly can then be removed from service and repaired at a later date and/or at different location. Moreover, since springs 37, 38 and 27 may be pre-compressed by the assembly of carriage 35 with intermediate component 39, all preloaded springs in nozzle 10 are contained within valve subassembly 21, which simplifies maintenance tasks. For example, no spring loading or unloading is necessary during field replacement of the components contained within valve subassembly 21, since a properly functioning complete subassembly can be installed in place of a malfunctioning subassembly without further field service on the any of the individual subassembly components.

Thus, assembly or disassembly of nozzle 10 in is made easier by valve subassembly 21. Referring still to 3, for assembly of nozzle 10, valve subassembly 21 is placed in the corresponding cavity 21' of nozzle body 12 with actuator 16 removed or partially detached from nozzle body 12 so that projection 32 does not interfere with downstream travel of valve subassembly 21 within nozzle body 12. With valve subassembly 21 sufficiently far in nozzle body 12, coupler 25 is threadably engaged with nozzle body 12, as shown in FIGS. 1 and 2. As coupler 25 is threaded in a downstream direction, a downstream end 25' of coupler 25 impinges upon an upstream end 39A of intermediate component 39 (FIGS. 4 and 5). The downstream end of carriage 35 is thus firmly seated against the end of the corresponding cavity of nozzle body 12 as coupler 25 is rotated.

Referring again to FIGS. 4 and 5, inner annular shoulder 25" of coupler 25 engages a corresponding structure on cap 57 to create a fluid tight seal therebetween. Further, a valve seat 26' formed on carriage 25 engages vapor control valve 26 to form a vapor tight interface therebetween. Optionally, the impingement of valve seat 26' against control valve 26 may slightly compress or preload vapor spring 37 and move the upstream end 42' of vapor control component 42 off of shoulder 40' of fluid control component 40. Projection 32 of actuator 16 may then be moved to the position shown in FIGS. 1 and 2 and secured about pivot point P, as discussed above. As shown in FIG. 3, hose coupler 31 may also be fitted against coupler 25 to effect a seal between a hose (not shown) and channel portion 24C.

As best seen in FIGS. 5 and 6, fluid control component 40 and vapor control component 42 can each include cut-out portions 60, 62 respectively. In the illustrated embodiment, cut-out portions 60, 62 are formed with a half moon or semi-annular shaped cross-section, but it is within the scope of the present invention that cut-out portions 60, 62 may take other shapes and configurations. Cut-out portions 60, 62 are sized to receive one or more coupling members 64, as discussed below.

The nozzle body 12 further includes one or more coupling members 64 (FIG. 2) that are moveable between an engaged position, in which they engage fluid and vapor control components 40, 42, and a disengaged position, in which they disengage from the fluid and vapor control components 40, 42. When coupling members 64 are in the engaged position, vapor control component 42 is axially coupled with fluid control component 40 and movement of the vapor control component 42 is transferred to the fluid control component 40. That is to say, when coupling members 64 are in the engaged position, both fluid and vapor control components 40, 42 move to their respective open positions in response to movement of actuator 16 to the open position. Thus, both fluid and vapor control valves 22, 26 can be opened by actuation of actuator 16. When coupling members 64 are in the disengaged position, only the vapor control component 42 moves in response to movement of actuator 16. Fluid control component 40 will not respond to movement of actuator 16 and will remain in its closed position as a result of the biasing force provided by shutoff spring 38 and/or valve spring 27. Accordingly, vapor control valve 26 may remain in its open position when fluid control valve body 22 is closed, depending on the position of coupling members 64. However, fluid control valve body 22 is will only open in response to actuation of actuator 16 when coupling members 64 are in the engaged position, and vapor control valve will therefore also be open.

When coupling members 64 are in the engaged position, they are positioned within cut-out portions 60, 62 to engage both fluid and vapor control components 40, 42. When coupling members 64 are in the disengaged position, they are positioned away from cut-out portion 62 and disengaged from vapor control component 42, which then becomes free to move axially with respect to fluid control component 40. The length of coupling members 64 may be greater than a width or diameter of fluid control component 40, such that when the coupling members 64 are disposed in the cut-out portions 60, 62 of the fluid and vapor control components 40, 42 they extend completely across the cut-out portions 60, 62.

Figure 7:
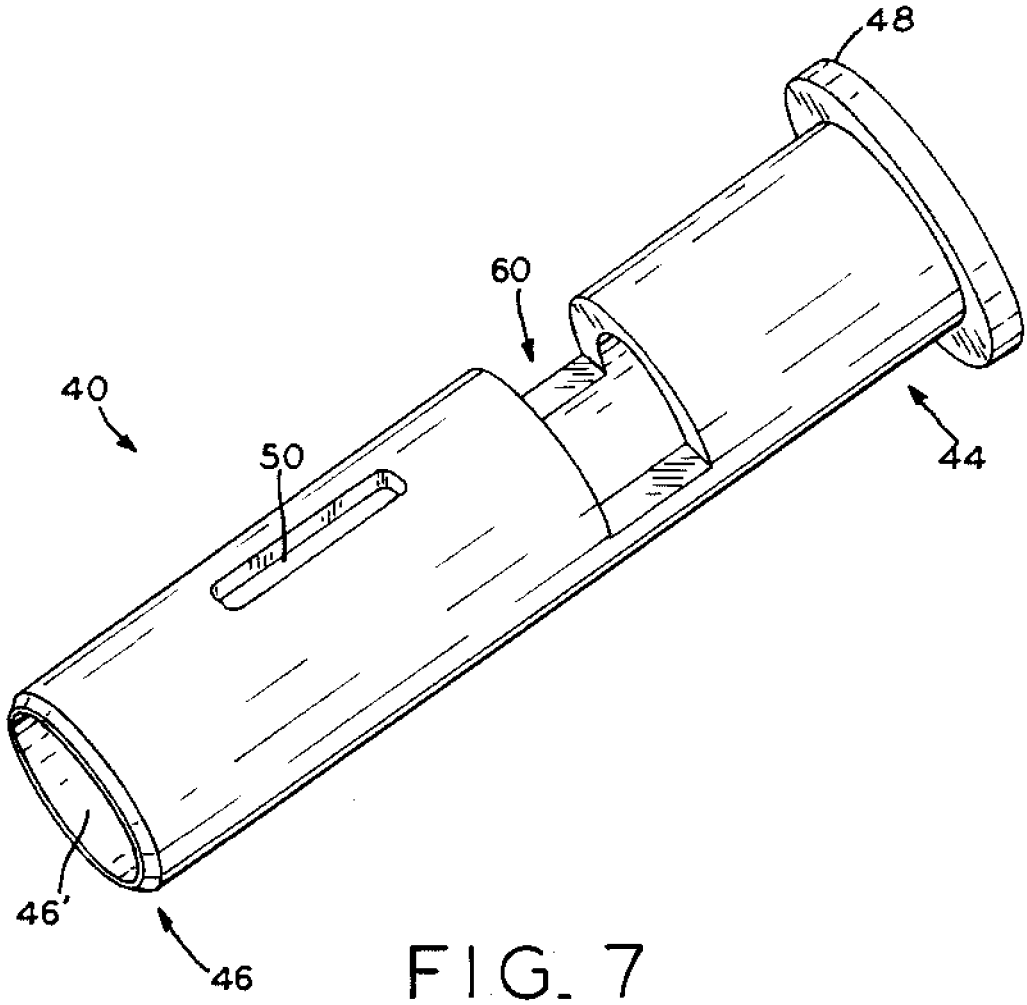
FIG. 7 is a perspective view of the fluid control component of the nozzle shown in FIG. 1.

Fluid control component 40 can include a pair of elongate slots 50 extending longitudinally along mutually opposed portions of fluid control component 40, as shown in FIG. 7. Slots 50 are disposed substantially parallel to each other for receiving projection 32 of actuator 16. Elongate slots 50 have sufficient width and length to allow projection 32 of actuator 16 to move freely therein along its entire range of motion, including when components 40, 42 are decoupled.

Vapor control component 42 is coupled to actuator 16 via projection 32, such that vapor control component 42 is moveable from the closed to the open position in response to actuation of actuator 16 from the inactive to the active position. For example, vapor control component 42 can include aperture 58 sized to receive projection 32 of actuator 16 (FIG. 2). Aperture 58 is sized such that movement of projection 32 of actuator 16 forces corresponding movement of the vapor control component 42. More particularly, actuation of actuator 16 can cause projection 32 to pivot at pivot point P and engage vapor control component 42 at aperture 58.

For dispensation of fluid from nozzle 10, actuator 16 is actuated as described above with coupling members 64 in the engaged position. Fluid control component 40 and vapor control component 42 allow fluid and vapor control valves 22, 26, respectively, to move to their open or activated positions (described above). When the vapor control valve 26 moves to the open position, the flow of vapor out through the nozzle body 12 along paths 24-24D commences, powered by a vacuum generator (not shown). The vacuum generator may, for example, be located within or adjacent to a fluid storage tank (not shown) that provides nozzle 10 with fluid. Thus, when vapor control valve 26 is open, vapors flow through vapor return channel 24 and past the vapor control valve 26 to a vapor return passage in the hose (not shown) to be returned to the storage tank (not shown).

Concurrently with the opening of vapor control valve 26, fluid valve body 22 opens and permits pressurized fluid to flow through channel 23A of coupler 25. Referring now to FIGS. 1B and 2, Channel 23A is in fluid communication with channel 23B of subassembly 21. As shown in FIG. 2, channel 23B is bounded by coupler 25 cap 57, key 55 and intermediate component 39. Channel terminates at valve body 22, where fluid is allowed to flow past valve body 22 when it is open. More specifically, fluid flows in to annular channel 35A defined by carriage 35 and out through an aperture 35A' formed in channel 35A (FIG. 4). The fluid then continues its downstream journey through channel 12B formed in nozzle body 12, which is in fluid communication with channel 12C via a connecting channel (not shown in the section view plane of FIGS. 1B and 2). From channel 12C, fluid flows directly in to fuel passage 28 of spout 14, as discussed above.

When actuator 16 is released and allowed to return to the closed position, vapor control component 42 returns to its closed position. More particularly, when actuator 16 is released from its open position, projection 32 returns to its unpivoted position, releasing vapor control component 42 from its open position, thereby allowing vapor spring 37 to return vapor control valve 26 to a closed position in which it is seated against valve seat 26' formed in coupler 25. Thus, movement of vapor control component 42 to its closed position forces vapor valve 26 closed.

Similarly, when actuator 16 is released from its active or raised position and components 40, 42 are coupled by coupling members 64, fluid control component 40 is biased toward its closed position by shutoff spring 38. Fluid control component 40 impinges upon valve body 22 and drives valve body 22 in to valve seat 39', thereby preventing any further flow of fluid past valve body 22. Alternatively, coupling members 64 may move to their disengaged position, in which they no longer engage vapor control component 42 (discussed in detail below). With components 40, 42 thus decoupled, fluid control component 40 will move independently of vapor control component 42 and shutoff spring 38 will bias valve body 22 to its closed position. Slots 50 are of sufficient length to allow axial translation of fluid control component 40 to close valve body 22, even with actuator 16 in the active position (and, accordingly, with projection 32 in a forward or downstream position). Thus, fluid control component 40 is capable of closing valve body 22 even when actuator 16 is activated and vapor control component 42 is open.

Vapor control valve 26 remains in the open position as long as actuator 16 is disposed in the active position. If latch 34 is used to maintain the actuator 16 in the active position (as discussed above), the force of the fluid control component 40 returning to the closed position during automatic shut-off may be sufficient to jar actuator 16 free from the active position, allowing vapor control component 42 to also return to the closed position. As previously discussed, the movement of vapor control component 42 to its closed position also brings vapor control valve 26 to the closed position.

The fluid control valve body 22 further includes one or more grooves (not shown) disposed on an exterior surface of the fluid control valve body 22. Preferably, the fluid control valve body 22 includes three grooves disposed around the exterior of the fluid control valve body 22. When fluid flows past the fluid control valve body 22, these grooves create a venturi effect, which generates a vacuum that pulls any fluid that has leaked into unwanted areas of the nozzle body 12 back to the fluid control valve body 22. This can eliminate a need for O-rings to seal off portions of the nozzle body 12 from the fluid flow.

Figure 8A:
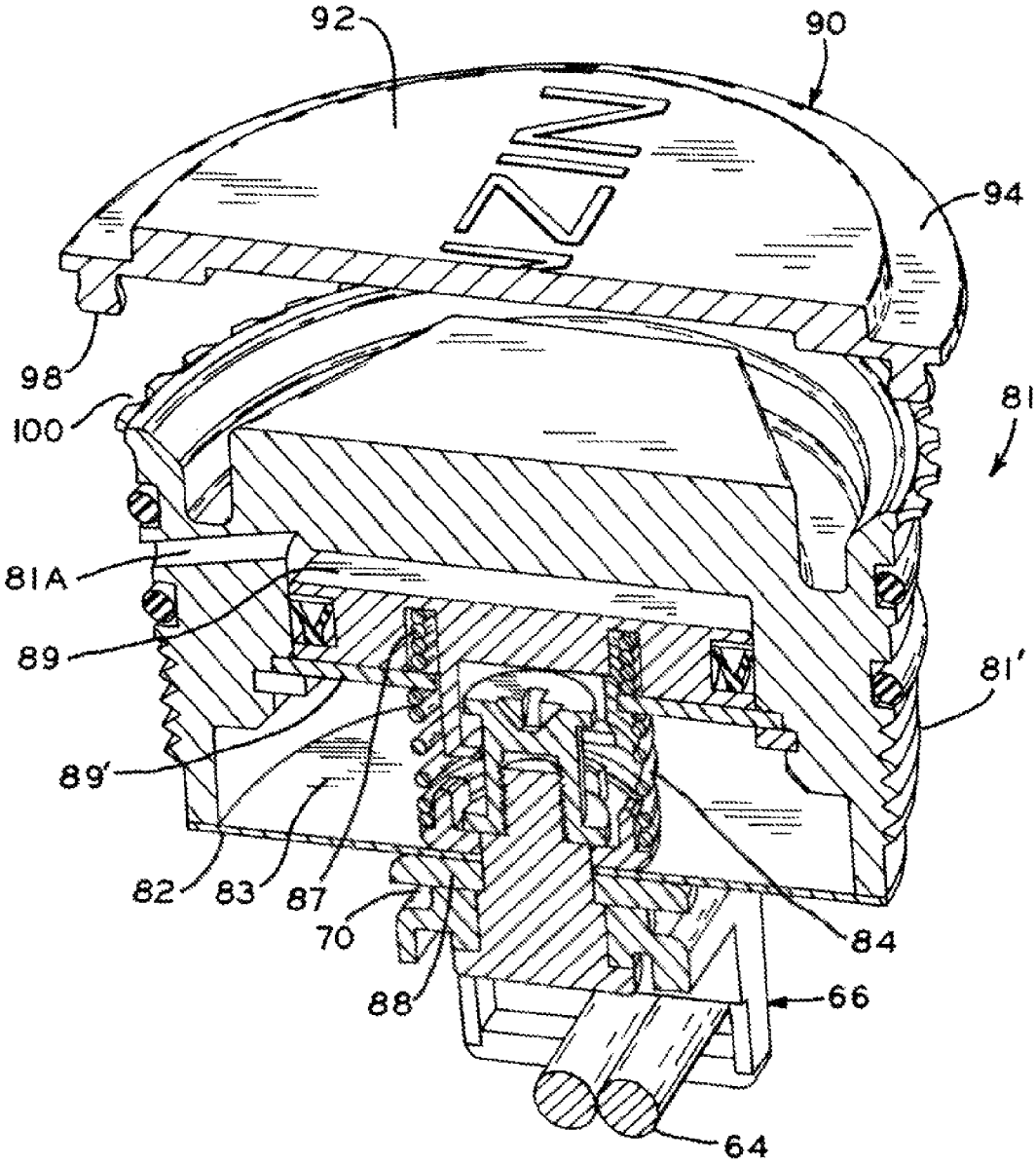
FIG. 8A is a perspective section view of an automatic shutoff system in accordance with the present invention, shown together with a product badge.
Figure 8B:
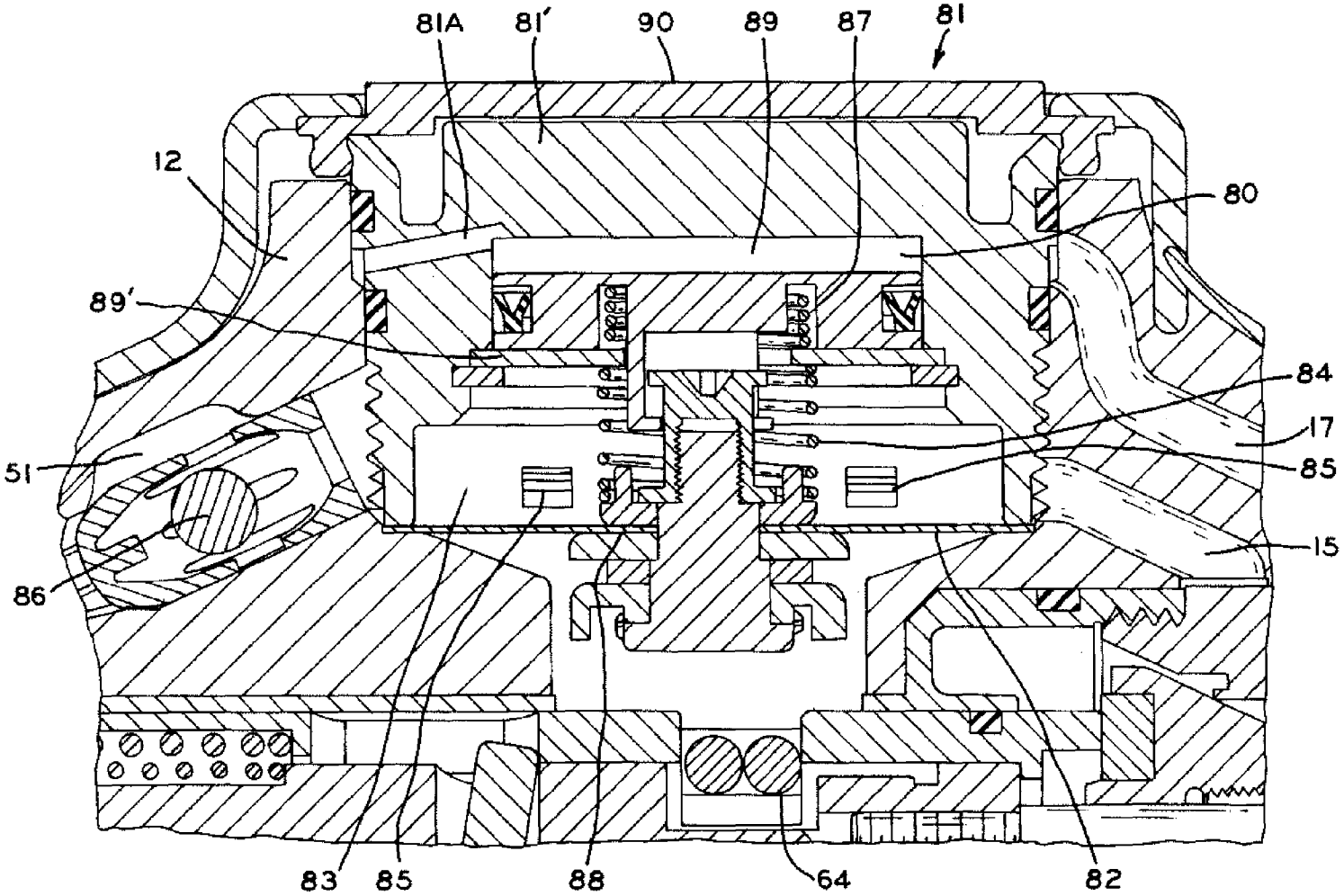
FIG. 8B is a section view of the automatic shutoff system of FIG. 8A, shown with the product badge attached.

Referring now to FIGS. 2, 8A and 8B, coupling members 64 may be moved between the engaged and disengaged positions by automatic shutoff system 81. In the illustrated embodiment, coupling members 64 are shown as elongate cylinders (FIG. 9), such as cylindrical rollers. Coupling members 64, however, can have any suitable size and shape. For example, a cross-sectional shape of the coupling members 64 can substantially correspond to the cross-sectional shape of cut-out portions 60, 62 of fluid and vapor control components 40, 42 respectively.

Figure 9:
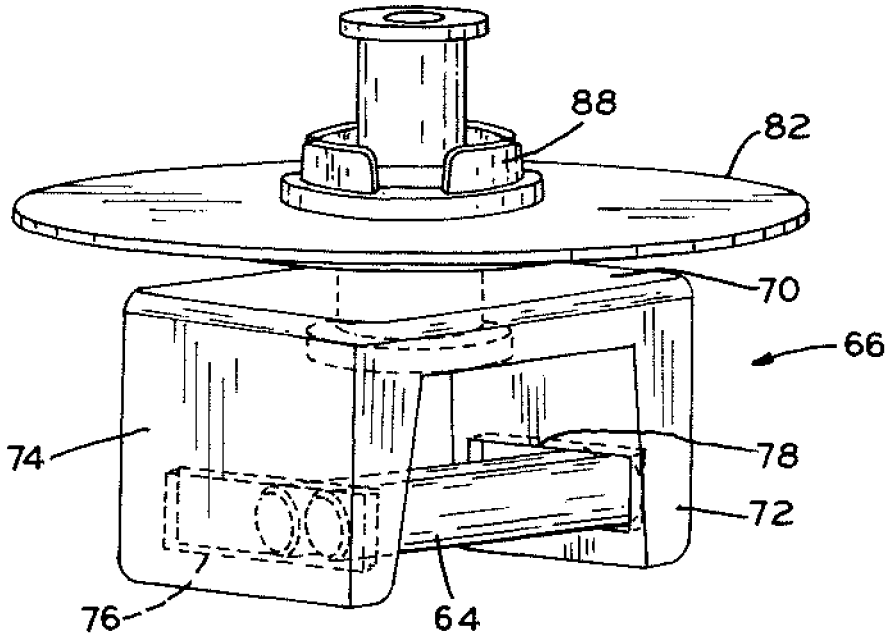
FIG. 9 is a perspective view of the diaphragm assembly of the nozzle shown in FIG. 1.

Referring to FIG. 9, coupling members 64 can be disposed in a bracket, such as an inverted U-shaped bracket 66 as shown in FIG. 9. The inverted U-shaped bracket 66 includes a top surface 70 and two downwardly projecting arms 72, 74. Each of downwardly projecting arms 72, 74 may include respective elongate slots 76, 78 at a bottom portion of arms 72, 74. Elongate slots 76, 78 are substantially parallel. End portions of coupling members 64 can be retained within elongate slots 76, 78, such that coupling members 64 can be shifted from a first or upstream position disposed near a first end of the elongate slots 76, 78 to a second or downstream position disposed near a second end of the elongate slots 76, 78.

Referring now to FIGS. 2 and 8B, automatic shutoff system 81 may be received within nozzle body 12. For example, a housing 81' of shutoff system 81 may be threadably received within chamber 80 to secure housing 81' and its contents (discussed below) to nozzle body 12. Housing 81' includes at least one vacuum port 85 in fluid communication with upstream vacuum channel 15 and downstream vacuum channel 51 in nozzle body 12 (FIG. 8B). Referring now to FIG. 1A, downstream channel 51 is in fluid communication with venting channel 29 via a path around fuel passage 28 (not shown in the section view plane of FIG. 1A). As described below, vacuum port 85 allows an accumulation of vacuum pressure to activate shutoff system 81.

Upstream vacuum channel 15 is fluidly coupled to intermediate component 39 and ultimately to spout 14. Fluid flowing past the venturi holes 39" of the valve seat 39' causes a venturi effect which creates a vacuum within upstream vacuum channel 15. The vacuum pressure is passed to downstream vacuum channel 51 and to venting channel 29. The vacuum pressure vents through the venting channel 29 in the spout 14 via the venting channel opening 30. Thus, a vacuum created by venturi holes 39" creates a steady draw of air through opening 30 when fluid is flowing past valve body 22.

Referring again to FIGS. 2, 8A and 8B, a fluid pressure sensing spring ("FPS spring 87") prevents dispensing of fluid from the nozzle body 12 when there is no fluid pressure within nozzle body 12 (i.e. when the dispenser is off). The force of the fluid pressure within nozzle body 12 is sufficient to compress FPS spring 87 from an extended position to a compressed position. When FPS spring 87 is in the compressed position and vacuum pressure in chamber 83 is low or zero (as discussed below), coupling members 64 are in their engaged positions. When there is no fluid pressure within nozzle body 12 (i.e. when the dispenser is off) FPS spring 87 moves to its extended position and urges coupling members 64 to the disengaged position, disengaging the coupling members 64 from vapor control component 42. Thus, as described above, movement of fluid control component 40 (and compression of shutoff spring 38) is prevented, even if actuator 16 is pulled to the activated position. Thus, fluid control component 40 remains in the closed position, keeping fluid control valve body 22 in the closed position, and preventing flow of fluid when there is no fluid pressure within nozzle body 12.

Fluid channel 17 (FIG. 1B) in nozzle body 12 conducts pressurized fluid from its flow path within subassembly 21 to automatic shutoff system 81. Housing 81' includes a fluid channel 81A in fluid communication with fluid channel 17 via an intermediate channel (not shown in the section view planes of FIGS. 1B, 2 and 8B). Pressurized fluid is introduced via inlet portion 18 and flows via fluid channels 17 and 81A in to outer chamber 80. The pressure of the introduced fluid causes plunger 89 to move inwardly against a biasing force provided by fluid pressure sensing (FPS) spring 87. Spring 87, in contact with plunger 89 at its outer end and with plate 89' at its inner end, is compressed to a compressed position by the inward motion of plunger 89. Since coupling members 64 are coupled with plunger 89 via U-shaped bracket 66 (FIG. 9), a result of the inward motion of plunger 89 is the movement of coupling members 64 in to their engaged position.

On the other hand, if plunger 89 is not moved inwardly by pressurized fluid, the potential for inward motion of coupling members 64 is abbreviated. This abbreviation prevents coupling members 64 from moving in to their engaged position, as discussed in more detail below. Thus, fluid will not flow past valve body 22 in response to actuation of actuator 16 unless plunger 89 is moved inwardly by pressurized fluid.

Referring again to FIGS. 1B, 8A and 8B, nozzle 10 can be designed to automatically shut-off the flow of fluid once the tank being filled is full. When the tank is full, the venting channel opening 30 becomes blocked or submerged in fluid, preventing vacuum pressure from venting through spout 14. The vacuum pressure builds in inner chamber 83 and forces flexible diaphragm 82 to an outer position, which pulls coupling members 64 to the disengaged position, decoupling fluid and vapor control components 40, 42. As a result, vapor control component 42 is no longer fixed to fluid control component 40, and fluid control component is free to move axially with respect to vapor control component (as discussed above). Fluid control component 40, biased by shutoff spring 38, returns to the closed position and forces fluid control valve body 22 to a closed or seated position.

Diaphragm 82 can be operatively coupled to the top portion of inverted U-shaped bracket 66. When diaphragm 82 is biased to an inner position by diaphragm spring 84, inverted U-shaped bracket 66 is maintained in an inner position in which coupling members 64 are disposed in the engaged position, coupling fluid and vapor control components 40, 42.

During normal operation of nozzle 10, no substantial vacuum pressure will accumulate in chamber 83 since it is vented to atmospheric pressure via downstream vacuum channel 51 and venting channel 29. If opening 30 is blocked, such as by fluid in a nearly full fluid tank, chamber 83 ceases to be vented to atmosphere and vacuum pressure will build in chamber 83. Diaphragm 82, disposed in inner chamber 83 and located at an inner portion of chamber 83 (i.e., toward the actuator 16), is flexible from a first or inner configuration to a second or outer configuration in response to the buildup of vacuum pressure within chamber 83. From the inner configuration, the diaphragm 82 can be moved or flexed generally away from actuator 16, and from the outer configuration, diaphragm 82 can be moved or flexed generally toward actuator 16.

In the illustrated embodiment, vacuum port 85 in housing 81' allows vacuum pressure to accumulate in inner chamber 83 of housing 81. If enough vacuum pressure accumulates to overcome the force of diaphragm spring 84, diaphragm 82 will move to an outer position, pulling coupling members 64 to the disengaged position. Fluid will thereby be prevented from flowing through nozzle 10, as described above.

Nozzle 10 can further include an attitude or level sensing mechanism designed to prevent dispensing of fluid when spout 14 is disposed above the horizontal. As best seen in FIG. 1B, for example, ball valve 86 can be disposed adjacent to chamber 83 in downstream channel 51 that is fluidly coupled to both the chamber 83 and venting channel 29 of spout 14. When spout 14 is disposed above the horizontal, ball valve 86 seals downstream channel 51 between chamber 83 and venting channel 29 of spout 14. Similar to automatic shut-off mechanism 81, this sealing prevents venting of the vacuum pressure within chamber 83. The built-up vacuum pressure forces diaphragm 82 to the outer configuration, which forces coupling members 64 to the disengaged position and decouples fluid and vapor control components 40, 42. If fluid control component 40 is in the open position before ball valve 86 seals downstream channel 51, the disengagement of coupling members 64 allows fluid control component 40 to return to the closed position, which forces fluid control valve body 22 to its closed or seated position. If fluid control component 40 was in the closed position, the disengagement of coupling members 64 prevents fluid control component 40 from moving to the open position in response to actuation of actuator 16 and fluid control valve body 22 remains closed.

The ability to perform a "dry test" of a nozzle is a desirable in some jurisdictions. Certain regulatory schemes, such as some in Europe, require that a nozzle's automatic shutoff and/or vapor recovery functionality be tested without the dispensation of any fluid. Referring now to FIG. 9, magnetic collar 88 can be operatively coupled to diaphragm 82 and to coupling members 64 to allow for dry testing of vapor recovery system. Magnetic collar 88 is preferably formed of a ferrous material and exhibits ferromagnetism, so that magnetic collar 88 is moveable between a magnetized position in which placement of a magnet (not shown) proximal magnetic collar 88 draws magnetic collar toward the magnet, and a non-magnetized position in which no magnet influences the movement of magnetic collar 88. Magnetic collar 88 may be plated to inhibit corrosion.

To dry test the vapor recovery system of the nozzle 10, a magnet (not shown) is positioned over diaphragm 82, on the exterior of nozzle 10. The magnetic attraction between the magnet and magnetic collar 88 moves magnetic collar 88 toward the magnet and in to the magnetized position, thereby forcing diaphragm 82 to the outer position. In the illustrated embodiment, the attraction of the magnet and magnetic collar 88 is strong enough to overcome the force exerted on plunger 89 by fluid pressure, as described above, and force any existing fluid out of chamber 80. Corresponding movement of diaphragm 82 disengages coupling members 64 from fluid and vapor control components 40, 42, allowing movement of vapor control component 42 in response to actuator 16 to be independent from the fluid control component 40 as discussed in detail above. Thus, while magnetic collar 88 is pulled by the magnet, moving actuator 16 to the activated position results in movement of only vapor control component 42 to the open position, which in turn moves vapor control valve 26 to the open position. Fluid control component 40 remains in the closed position, maintaining fluid control valve body 22 in the closed position. Fluid flow through nozzle body 12 is prevented by fluid control valve body 22, while the vapor control valve 26 remains open. Advantageously, dry testing of the vapor recovery system can then be completed according to any known methods without dispensation of fluid through nozzle 10. For example, a flowmeter device can be placed over spout 14 and vapor return channel 24 to measure the flow created by vacuum pressure in the storage tank via control valve 26. Although the illustrated embodiment features magnetic collar 88 being attracted by the magnet, it is within the scope of the present invention that the magnet may repulse magnetic collar 88 to move diaphragm 82.

Figure 10:
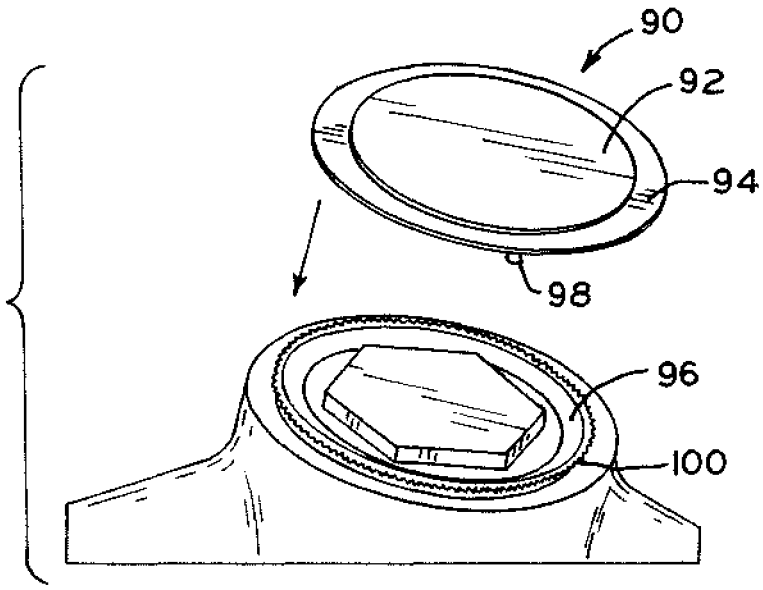
FIG. 10 is a perspective view of the product badge of the nozzle shown in FIG. 1.

Referring now to FIG. 10, nozzle 10 may include product badge 90 disposed on the exterior of nozzle body 10. As shown in FIG. 1B, for example, nozzle 10 can further include a product badge 90 disposed above housing 81' of shutoff system 81. Housing 81' can further include exterior cap 96 adapted to receive product badge 90. The product badge 90 includes first portion 92 and second portion 94. First portion 92 can be stepped upwardly from second portion 94 and can have a smaller diameter than second portion 94. Product badge 90 is secured against the exterior of the nozzle body by forming boot 102 (FIGS. 1A, 1B and 3) over product badge 90 as well as nozzle body 12. Boot 102 can be formed over second portion 94 of product badge 90 so that first portion 92 (FIGS. 1B and 10) and any product logos, other symbols, or wording thereon remain visible. In this configuration, product badge 90 cannot be lifted off from the exterior of the nozzle without first removing boot 102. Product badge 90 can further include pins 98 downwardly extending from a perimeter of second portion 94 that snap-fit into pin receiving grooves 100 formed on a top exterior surface of the nozzle body 12 to further secure product badge 90 on the exterior of the nozzle body. For example, exterior cap 96 of housing 81' can include pin receiving grooves 100 around its perimeter (FIG. 10), or grooves 100 may be formed in housing 81' (FIG. 8A).

Optionally, sealing elements may be provided at interfacing surfaces within nozzle 10 to aid in a fluid-tight seal between such surfaces. For example, O-ring seals are generally shown in the Figures on annular surfaces of spout 14, subassembly 21, and housing 81' of shutoff system 81. O-rings are also shown at sealing surfaces within subassembly 21, such as at the interface between valve seats. However, it is within the scope of the invention to use any known sealing methods to provide a fluid-tight seal, such as silicone, sleeves, bushings and the like. Sealing elements may also be left out completely.

Although an exemplary embodiment of the present invention is used for fuel dispensation to vehicle fill tanks, it is within the scope of the present invention to dispense any fluid from a tank or dispenser such as chemical mixtures, water, beverages, or any other liquid or flowable material.

From the foregoing, it will be observed that numerous variations and modifications may be affected without departing from the spirit and scope of the invention. It is to be understood that no limitation with respect to the specific apparatus illustrated herein is intended or should be inferred.

What is claimed:

1. A nozzle for dispensing fluid, the nozzle comprising:

a nozzle body having an inlet end and an outlet end;

a self-contained valve subassembly receivable within and separable from said nozzle body as a subassembly, said valve subassembly comprising:

a fluid control component moveable between an open position and a closed position;

an intermediate component;

a fluid control valve having a valve body and a valve seat, said fluid control valve moveable from a closed position in which said valve body is seated in said valve seat to an open position in which said valve body is spaced away from said valve seat, said fluid control valve moveable to its open position when said fluid control component is in its open position, a vapor control component moveable between an open position and a closed position;

a carriage sized to receive said fluid control component and said vapor control component, securement of said carriage to said intermediate component capturing said fluid control component, said fluid control valve and said vapor control component between said carriage and said intermediate component to form said self-contained valve subassembly; and a vapor control valve operably coupled with said vapor control component, said vapor control valve moveable between a closed position and an open position in response to a corresponding movement of said vapor control component.

2. The nozzle of claim 1, wherein said self-contained valve subassembly further comprises a biasing means for closing said fluid control valve, said biasing means biasing said fluid control component toward said valve body, the securement of said carriage to said intermediate component further capturing said biasing means between said carriage and said intermediate component.

3. The nozzle of claim 1, further comprising at least one coupling member disposed in said nozzle body, said coupling member moveable between an engaged position in which said fluid control component and said vapor control component are coupled, and a disengaged position in which said fluid control component and said vapor control component are decoupled, wherein said vapor control component is moveable with respect to said fluid control component when said at least one coupling member is in the disengaged position.

4. The nozzle of claim 1, wherein said self-contained valve subassembly further comprises a rolling diaphragm having a first end coupled to said nozzle body and a second end coupled to said fluid control valve, such that said rolling diaphragm sealingly isolates said vapor control valve from said fluid control valve.

5. The nozzle of claim 4, wherein said vapor control valve is positioned to interrupt a vapor flow path and said fluid control valve is positioned to interrupt a fluid flow path, said roiling diaphragm disposed between the vapor flow path and the fluid flow path.

6. The nozzle of claim 1 further comprising a coupler having a vapor control valve seat shaped to cooperate with said vapor control valve, said coupler coupled to said nozzle body at said inlet end, and said valve subassembly being urged toward said outlet end by said coupler when said coupler is coupled to said nozzle body.

7. The nozzle of claim 6 wherein a biasing means for closing said vapor control valve biases said vapor control component toward said vapor control valve, said vapor control component urging said vapor control valve toward said vapor control valve seat, the securement of said carriage to said intermediate component further capturing said biasing means for closing said vapor control valve between said carriage and said intermediate component.

8. A method of assembling a nozzle comprising the steps of:

pre-assembling a self-contained valve subassembly, the step of pre-assembling including:

installing a fluid control component into a carriage, such that the fluid control component is moveable within the carriage between an open position and a closed position;

installing a fluid control valve proximal said fluid control component, such that said fluid control valve is in a closed position when said fluid control component is in its closed position;

installing a vapor control component into said carriage, such that the vapor control component is moveable independently of said fluid control component within the carriage between an open position and a closed position; and coupling a vapor control valve to said vapor control component, such that said vapor control valve is in a closed position when said vapor control component is in its closed position;

inserting said self-contained valve subassembly into a nozzle body of the nozzle along a direction of insertion; and attaching a coupler to said nozzle body, the coupler urging said valve subassembly in the direction of insertion to couple said valve subassembly with said nozzle body.

9. The method of claim 8, wherein said step of pre-assembling said self-contained valve subassembly further comprises:

installing a fluid control biasing element into said carriage, such that the fluid control biasing element biases said fluid control valve toward its dosed position;

at least partially compressing said fluid control biasing element by engaging an intermediate component with said carriage, said intermediate component capturing said fluid control biasing element, said fluid control component, and said fluid control valve when said intermediate component engages with said carriage.

10. The method of claim 8, wherein said step of pre-assembling said self-contained valve subassembly further comprises:

installing a vapor control biasing element into said carriage, such that the vapor control biasing element biases said vapor control valve toward its closed position;

at least partially compressing said vapor control biasing element by engaging an intermediate component with said carriage, said intermediate component capturing said vapor control biasing element and said vapor control component, when said intermediate component engages with said carriage.

11. The method of claim 10, wherein said coupler includes a vapor control valve seat shaped to cooperate with said vapor control valve, said step of attaching said coupler further comprising:

engaging said vapor control valve seat with said vapor control valve to urge said vapor control valve along said direction of insertion.

12. The method of claim 11, wherein said vapor control biasing element biases said vapor control component toward said vapor control valve, said vapor control component urging said vapor control valve toward the closed position of the vapor control valve, said step of attaching said coupler further comprising:

compressing said vapor control biasing element to bias said vapor control valve toward said vapor control valve seat.

13. The method of claim 8, wherein said coupler includes a vapor control valve seat shaped to cooperate with said vapor control valve, said step of attaching said coupler further comprising:

engaging said vapor control valve seat with said vapor control valve to urge said vapor control valve along said direction of insertion.

14. The method of claim 8, further comprising installing at least one coupling member in said nozzle body, such that said coupling member moveable between an engaged position in which said fluid control component and said vapor control component are coupled, and a disengaged position in which said fluid control component and said vapor control component are decoupled, wherein said vapor control component is independently moveable with respect to said fluid control component when said at least one coupling member is in the disengaged position.

15. The method of claim 8, wherein said step of pre-assembling said self-contained valve subassembly further comprises:

coupling a first end of a rolling diaphragm to said nozzle body;

coupling a second end of said rolling diaphragm to said fluid control valve, such that said rolling diaphragm sealing isolates said vapor control valve from said fluid control valve.

16. The method of claim 15 further comprising:

positioning said vapor control valve within the nozzle body to selectively interrupt a vapor flow path; and positioning said fluid control valve within the nozzle body to selectively interrupt a fluid flow path; and disposing said rolling diaphragm between the vapor flow path and the fluid flow path.

* * * * *